US005163270A

United States Patent [19]

Treiber

[11] Patent Number: 5,163,270

[45] Date of Patent: Nov. 17, 1992

[54] TANDEM HANDWRAP STATIONS AND METHOD FOR STRETCH FILM

[76] Inventor: Fritz F. Treiber, c/o Hobart Corporation, Troy, Ohio 45374

[21] Appl. No.: 621,682

[22] Filed: Dec. 3, 1990

[51] Int. Cl.[5] ..... B65B 11/02; B65B 67/10

[52] U.S. Cl. ..... 53/415; 53/136.1; 53/202; 53/210; 53/219; 53/390; 53/463; 53/465; 53/508

[58] Field of Search ..... 53/168, 202, 219, 390, 53/391, 502, 508, 131.2, 136.1, 210, 415, 463, 465, 375.9

[56] References Cited

U.S. PATENT DOCUMENTS

| | | | |
|---|---|---|---|
| 2,921,424 | 1/1960 | Wertheimer | 53/390 |
| 2,948,466 | 8/1960 | Allen et al. | 235/58 PS |
| 3,579,949 | 5/1971 | Michels | 53/390 X |
| 3,800,499 | 4/1974 | Feldman | 53/168 |
| 4,423,486 | 12/1983 | Berner | 177/25.13 X |
| 4,551,962 | 11/1985 | Kawahara | 53/390 X |

FOREIGN PATENT DOCUMENTS

| | | | |
|---|---|---|---|
| 1430388 | 1/1966 | France | 53/390 |
| 1206441 | 9/1970 | United Kingdom | 53/391 |

*Primary Examiner*—John Sipos
*Assistant Examiner*—Linda B. Johnson

[57] ABSTRACT

Manual wrap stations for handwrapping of trayed products in film are arranged in back-to-back fashion. They have a common wrap surface between them to provide a reduced-cost, space-saving tandem or dual hand wrap station. Two operators face each other during wrapping and alternately use the common wrap surface. In a preferred form, the wrap surface is either a weighing scale platter itself or the platter can be alongside a separate wrap surface. In either such form, the system enables weighing, computing, label printing and hand labeling of wrapped products without loss of productivity. The arrangement eliminates the need for an additional computing scale and label printer, such as would be necessary to obtain the same productivity with separate wrap stations using such equipment. An audible signal is provided to indicate that the scale has completed a weighing, enabling ease of the operators' pacing of their alternating manual functions, without each having to watch the other's actions. One operator can take a shorter break in his action and return, without disrupting the functioning of the other.

11 Claims, 2 Drawing Sheets

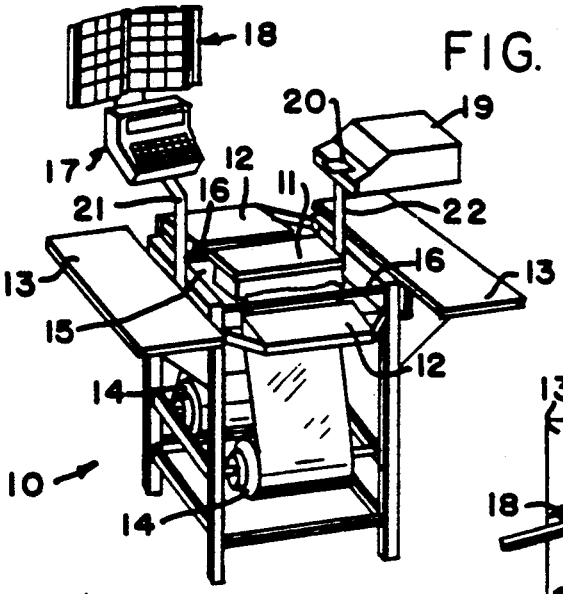
FIG. 1
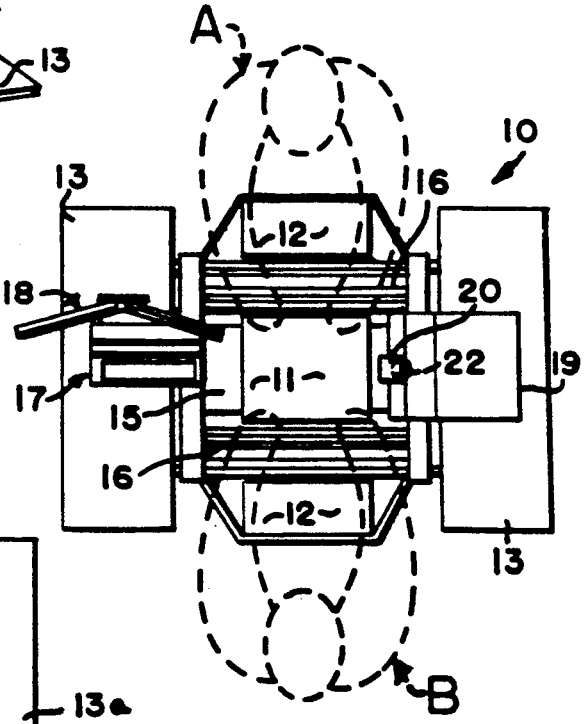
FIG. 2
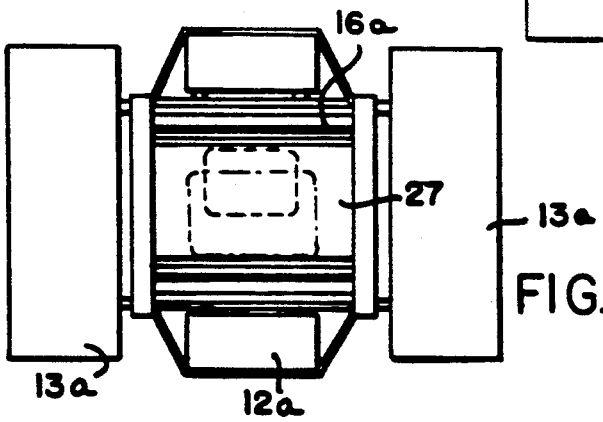
FIG. 4
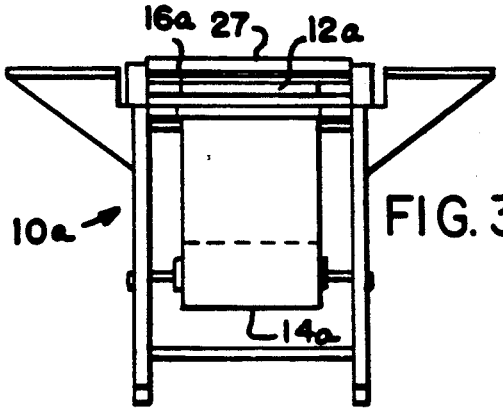
FIG. 3
FIG. 5
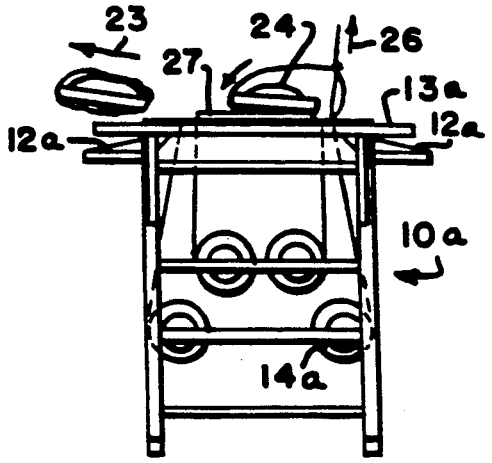

TANDEM HANDWRAP STATIONS AND METHOD FOR STRETCH FILM

TECHNICAL FIELD OF THE INVENTION

This invention relates primarily to systems for hand wrapping trayed products such as meat or produce in stretch film such as polyvinyl chloride (PVC).

BACKGROUND OF THE INVENTION

For several decades, PVC and other types of stretch film have been made available as a low cost means of providing sealed packages of food. A wrapped package consists of a sheet of film overlying trayed produce and having its edges tucked beneath and overlapping at the underside of the tray. The overlapped edges are conventionally heat sealed by briefly placing the wrapped package on a heated pad. Hand wrapping is normally accomplished in the manner illustrated in U.S. Pat. No. 3,579,949, issued to C. E. Michels. There is illustrated in that patent a handwrap station with one or more rolls of stretch film supported below a table surface. An operator standing at one side of the table pulls the leading edge from the film roll by grasping it at the corners, raises it, passes the film over the product and partly tucks the lead edge under the product while it rests on a wrap table or wrap bridge. The film and product are then drawn toward the operator and severed from the roll. This initially forms a sleeve. The outer edges of the sleeve are then stretched outwardly and tucked beneath the side edges of the package. The package is then placed on a sealing pad which is located adjacent the operator and typically heated to a temperature to cause the overlapping edges of the film to adhere. Under some circumstances a package is also temporarily touched to the sealing pad while still in sleeve form and before the two sleeve ends are tucked under. Frequently, the handwrap station is associated with a scale and label printer alongside, as shown in Berner U.S. Pat. No. 4,423,486, or the scale portion of the weighing/labeling system can be placed on the wrap table as illustrated in Kawahara U.S. Pat. No. 4,551,962.

Since stretch film wrapper has essentially replaced wrapping in cellophane and other types of film, and since the type of film used has no direct bearing on the invention itself, it should be understood that the term "stretch" embodies other films as well.

SUMMARY OF THE INVENTION

This invention contemplates use of two such operationally independent handwrap stations in back-to-back fashion as a single, mechanically interdependent tandem system, for advantages to be described. In the preferred form of the invention, the tandem system embodies a single weighing/label printing system that is operator-reachable from both handwrap stations. So constructed, the capital cost of the equipment for producing wrapped packages is substantially reduced without compromising the wrapping productivity of two operators. Such a tandem system is not only less costly as a capital outlay to the owner, but it also occupies less floor space in a supermarket meat room, the area where floor space is extremely important and most expensive. The space-saving aspect of the invention is important whether the tandem unit includes or does not include a weighing/label printing system. The tandem system in either form allows for independent use of either station at any time, or simultaneous use of both stations during "peak" hours and "peak" days such as those periods just preceding very active shopping hours, weekends or holidays.

In the version which includes weighing and labeling, signal means is preferably provided to enable a pair of operators facing each other to alternately wrap and utilize the scale platter which constitutes the wrap table while focusing solely on their own actions upon receipt of an audible signal to start. The signal indicates that a weighing operation has been completed and label printing has taken place, so that one operator can commence wrapping his weighed and trayed product as soon as the other operator has removed the label printed for the previously wrapped package from the printer. The weighing/label printing system is preferably a conventional system which inhibits a second label printing from taking place until a label for the previous package has been removed from the printer, as is well known in the art.

BRIEF DESCRIPTION OF THE DRAWINGS

FIG. 1 illustrates of a pair of back-to-back or tandem handwrap stations with a weighing scale platter utilized as the wrap table, a label printer at one side and a keyboard at the other side of the tandem unit.

FIG. 2 is a plan view of the system of FIG. 1 indicating the work positions of a pair of operators using the system at the same time.

FIGS. 3, 4 and 5 illustrate a second version of my invention without a weighing/label printing system and represent elevational, plan and side views respectively of a tandem handwrap system.

DETAILED DESCRIPTION OF THE INVENTION

Figure 6:
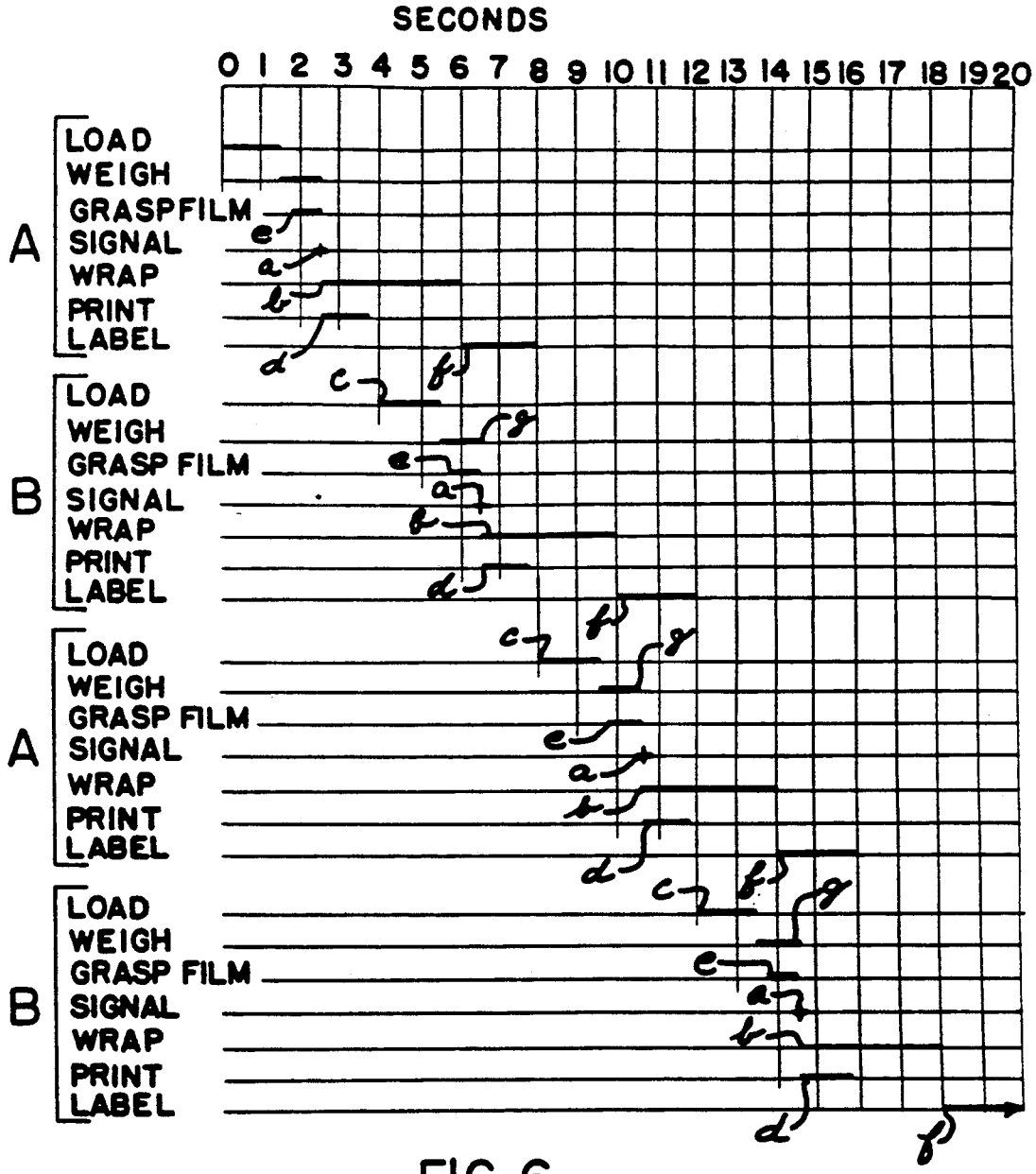
FIG. 6 is a chart exemplifying two operators utilizing the embodiment of FIGS. 1 and 2, alternately wrapping packages.

FIG. 1 illustrates a table 10 centrally supporting a weighing scale platter 11 of a load cell computing scale between a pair of heating or sealing pads 12 and a pair of opposed side shelves 13. The well-known table 10 consists of legs and cross bars to provide a supporting structure for the heating pads, shelves and one or more rolls 14 of stretch film for each operator, to enable standard hand wrapping in accordance with the principles discussed in the aforementioned U.S. Pat. No. 3,579,949. Depending upon the vertical depth of the weighing scale, the platter 11 and weighing mechanism therebeneath may rest on a recessed table surface 15 so as to present the top surface of the platter 11 slightly above a separately controlled hot wire or cutoff rod 16 between platter 11 and each heating pad 12.

At one side of table 10 there is provided a keyboard and price look-up (PLU) book 18 used to identify the code for each different product to be wrapped. On the opposite side of the platter 11 from a keyboard 17 is located a printer 19 which issues labels 20 within reach of operators A and B (FIG. 2). The keyboard/PLU and the printer 19 are mounted on swivel posts 21 and 22, respectively. The swivel post 21 allows an operator at either side to have the keyboard 17 facing that operator. The swivel post 22 allows the printer to be positioned where, if only one operator is using the system at any given time, labels can be issued toward that operator, rather than being accessible from both sides as shown in FIGS. 1 and 2.

FIG. 2 illustrates a plan view of the tandem hand-wrap stations of FIG. 1. Both operators A and B are shown utilizing the platter 11 as a common wrap table or wrap bridge. Operator B has the keyboard 17 and PLU book 18 facing him and will enter the appropriate product code into the system to enable the scale, computer and label printer to print a label indicating a variety of information of labels. Most typically, the information includes at least the weight of the item, the price per unit weight and the total cost of a wrapped package. For reference to how the keyboard and PLU book are utilized, Berner U.S. Pat. No. 4,423,486 is hereby incorporated by reference. Generally, each product has a numerical product code. For example, pork loin may be designated by numeral 207. By punching that number into the keyboard, data in a central processing unit, not shown, is accessed. Then while wrapping pork loins, the scale and its computer function to have the printer appropriately print information on labels, one at a time, relating to that data.

In accordance with known techniques, the printer 19 has associated therewith a print inhibiting means in the form of a label-taken sensor (not shown), which prevents the placement of a weight on the scale platter 11 from having any action or affect to print a new label until the previously-produced label 20 has been removed from the printer. An early form of such device is shown in Allen et. al. U.S. Pat. No. 2,948,466, which is incorporated herein by reference. That prevents any disturbance of the scale platter from disrupting the system, such as could occur when adding a new trayed product thereto if the previous label has not yet been removed from the printer. For most efficient operation, an audible sound device is provided in response to a completed weighing operation. The audible signal is in the nature of a momentary "beep" (see "a" in FIG. 6) such as is commonly provided at checkout counters of supermarkets where Universal Product Code (UPC) scanning takes place. In that instance, each beep signals the operator that scanning has been accomplished and the information has been transmitted to the cash register and cash register receipt. In the present invention, the beep signal is an indication that a completed weighing, computing and start of printing have taken place. The signal tells the operator who placed a given package on the scale that he can commence wrapping ("b" in FIG. 6) that package and also tells the other operator that he can load ("c" in FIG. 6) his trayed product onto scale platter 11.

Referring specifically to FIG. 6, at a first weighing by operator A, the platter 11 will settle in a fraction of a second, the beep will occur at "a" as the printer motor starts at "d", and wrapping may commence. When the beep occurs, the printer is already performing its function in response to the computer to print and issue a label 20 as shown in FIG. 1 and 2. As soon as operator A has started to move the package off the scale platter 11 to start wrapping at "b", second operator B can load his trayed product as at "c" onto the platter 11 and grasp the lead edge of film from a roll as at "e". The wrapping motions are best illustrated in the side view of FIG. 5, of the non-scale embodiment of my invention by arrows 23 and 26 when wrapping trayed product 24 with film from roll 14*a*. However, until the beep "a" sounds in the scale embodiment, the operator should not begin placement of the film over the package 24 because label removal for the previous package has not yet taken place. If the first operator is slow in removing the label 20, for example by having been distracted temporarily, wrapping of the next package should not be started. When the label 20 is finally removed from the printer 19 at "f", the aforementioned well-known label-taken sensor will allow a new weight signal to be transmitted to the computer at "g". For example, note in FIG. 6 that the label for the first package is removed by operator A at 6 seconds for hand placement on the package. Operator B, in the meantime, had previously loaded the scale at 3½ seconds and can grasp the lead edge of the film, but the beep "a" can't occur until after A has taken his label from the printer, until a about 6½ seconds. This assumes a continuous alternating operation. However, if operator A is distracted for several seconds and does not remove his label, operator B will receive the signal later by an amount equal to the time lost by operator A, affecting productivity according. A good team of operators can alternately wrap with practically no lost time or motion. However, if one or both operators are new or inexperienced, time lost by either one affects total productivity. Utilization of the beep in the embodiment of FIGS. 1 and 2 improves the total operation by enabling each operator to ignore watching what the other is doing. He can concentrate totally on his own function, listening solely for the audible beep to signal when wrapping can commence. The example of FIG. 6 shows average speed for an average weight package (about two pounds). The side shelves 13 in FIGS. 1 and 2 and 13*a* in FIGS. 3 to 5 receive large pans (not shown) that are almost the size of the shelves. (Selected elements common to both embodiments are designated with the additional letter "a" in FIGS. 3–5.) Depending on the manner in which the two operators wish to operate, the pan on one shelf 13 can contain a large number of unwrapped trayed products and an empty pan may be on the other shelf for receiving completely weighed and wrapped product. Obviously, if one shelf 13 or 13*a* has unwrapped product and the other finished product, one operator will be working right-to-left and the other left-to-right. If desired, smaller pans of product may be used, each operator having one which is being emptied for wrapping and the other receiving finished product. This would enable each operator to have work flow in the direction most convenient, irrespective of the work flow of the other operator.

The weighing/label printing mechanism functions regardless of whether both operators A and B or only one of them are wrapping. The beep is of no consequence when only one station is occupied, i.e., it has no function as a signal to commence wrapping under this condition, because a single operator can only do one complete package at a time. Weighing will occur as soon as the package is placed on the platter 11, even before the film leading edge can be grasped.

In still another embodiment which can be essentially comparable in performance to the embodiment of FIGS. 1 and 2, the scale platter 11 may occupy a space below either the keyboard 17 or the printer 19, i.e., overlying one of the shelves 13. Or, the scale can be at one side of the wrap table, and the PLU, keyboard and label printer at the opposed side, within reach of both operators. Such variations are considered to be within the scope of my invention, even though the version of FIGS. 1 and 2 is preferred, provided alternately functioning operators can utilize a common surface to support packages in a tandem system.

In the embodiment of FIGS. 1 and 2, wrapping of different size packages of the same product can take place, as shown by dotted and dot-dash lines in FIGS. 4, provided the tare weight of the different size trays is the same.

In the embodiment illustrated in FIGS. 3-5, where wrapping alone is accomplished and weighing/labeling is to take place alongside the wrap table, at a remote location or not at all, the operators can even wrap different products.

The systems shown and described are designed for simultaneous use by two operators alternating wrapping (and also weighing/ labeling in the preferred version) or can be used by one person utilizing a single wrap station. The rate of a reasonably good film hand wrapping operator is seven packages per minute. Initial tests conducted on a prototype tandem unit with two operators pacing themselves resulted in a rate of thirteen to fifteen packages per minute, essentially double that of a single operator with a standard single handwrap station or essentially the same as two operators at two independent stations. As soon as one operator (for example, at the left of FIG. 5) removes the trayed product from the table 27, the operator at the right can immediately place his trayed product on the wrap table and commence wrapping. And, as noted earlier in connection with the description of the invention shown in FIGS. 1 and 2, if the table 27 a scale platter 11, the only thing for which the operator at the right of FIG. 5 would have to wait would be the beep indicating that a weight signal had been transmitted to the printer 19, and label printing has been started.

What I have thus achieved is a compact tandem hand wrapping system which occupies approximately 25% less floor space than a pair of comparable, separate handwrap systems. Additionally, in the instance where a present-day weighing/label printing system is employed, as much as 40% of the cost of two separate wrapping, weighing and labeling systems can be saved, depending on the design and construction of the table 10 and the weighing/ labeling system.

Having described my invention, I claim:

1. In a combined package weighing, handwrapping and label printing system for use by either a single operator positioned at either one of two facing operator stations and weighing, hand wrapping and labeling packages at a first productivity rate or by a pair of operators facing each other at both operator stations and alternately staggering sequential weighing, hand wrapping and hand labeling operations at a second productivity rate essentially double the first productivity rate, a roll stand between said facing operator stations and supporting a pair of laterally-aligned rolls of stretch film, each of said rolls being within easy reach of respective operators at each of said stations, said stand including a pair of means for locating the lead edge of at least one roll of film, each locating means being for respective operators when operating at said second productivity rate, a single computing weighing scale for both operators having a scale platter within easy reach of both operators when standing in facing position at their stations, a pair of heat sealing pads, each pad adjacent a respective operator station, a air of film cutting means, each film cutting means between each said heat sealing pad and its adjacent lead edge location point, the horizontal dimension of said platter in the direction between the operators and the relation of the other elements of said system enabling one operator to: (a) place an unwrapped trayed product on said platter for weighing the same, (b) take the film lead edge in hand, (c) place it over the weighed product by tucking the edge therebeneath while on the platter and, in known fashion, (d) pull the product and film toward the operator to form a film sleeve, (e) sever the film, (f) underfold the ends of the sleeve below the package and (g) place the weighed and wrapped package on the sealing pad to heat seal the overlapping film on the package bottom, and, upon removing the trayed product from the platter, enabling the other operator to commence performing the same sequence of steps (a) through (g) with similar elements of said system by utilizing the same scale platter for weighing, a single means available to at least one of the operators for inputting information identifying the product and its unit price to a computer for computing the total value of each weighted product in response to receiving both operator information relative to its unit price and a weight input signal from the weighing scale relative to its weight, a single label printing means for both operators responsive to signals from said scale and computer including label-delivery means within easy reach of both operators at said operator stations, for printing and delivering a label identifying the unit price, weight and total value of each package, and printer inhibiting means associated with said label delivery means for preventing printing of a label until the label for the immediately-preceding weighed package has been removed from the label delivery means for hand application to its package, whereby two facing operators can perform staggered weighing, hand wrapping and hand labeling at said second productivity rate independently of each other while utilizing the common scale platter and label printing and delivery means without interfering with each other.

2. The combined system of claim 1 including a shelf at each side of said stand and located at right angles to the operator stations, the shelf at one side supporting large pans of multiple trayed products to be wrapped, and at the opposite side, for receiving completely weighed, wrapped and labeled products.

3. The combined system of claim 2 wherein the pans of unwrapped and completed product contain a single type of product about which information has been provided to the computer by said information inputting means.

4. The combined system of claim 1 wherein said scale platter is centrally located over said stand and is in line with the film rolls whereby said scale platter can also serve to support the trayed product during the commencement of tucking an initial edge of film beneath the product to be wrapped.

5. The combined system of claim 1, wherein said means for inputting information identifying the product is mounted above and alongside the stand on a swivel, within reach of and operation from either work station.

6. The combined system of claim 1, wherein momentary audible signal means is provided and wherein said signal means is responsive to label removal.

7. In a handwrap system for use by either a single operator at either of two facing operator stations at a first productivity rate or by a pair of operators facing each other at both operator stations and alternately staggering hand wrapping operations at a second productivity rate essentially double the first productivity rate, a roll stand between said facing operator stations and supporting a pair of laterally-aligned rolls of stretch film, each of said rolls being within easy reach of respective operators at the stations, said stand including a pair of means for locating the lead edge of at least, each locating means being one roll of film within easy grasp of respective operators, a single wrapping table for both operators having a product supporting surface between and within easy reach of both operators when standing in facing position at their stations, a pair of heat sealing pads, each pad adjacent a respective operator station, and a pair of film cutting means each film cutting means between each pad and its adjacent lead edge location point, the improvement comprising:

the horizontal dimension of said wrapping table in the direction between the operators and the relation of the other elements of said system enabling one operator to: (a) place an unwrapped trayed product on said table, (b) take the film lead edge in hand, (c) place it over the product by tucking the edge threbeneath while on the table and, in known fashion, (d) pull the product and film toward the operator to form a film sleeve, (e) sever the film, (f) underfold the ends of the sleeve below the package and (g) place the wrapped package on the sealing pad to heat seal the overlapping film on the package bottom, and, upon removing the trayed product from the table, enabling the other operator to independently commence performing the same sequence of steps (a) through (g) with similar elements of said system by utilizing the same product supporting surface for commencing wrapping.

8. The combined system of claim 7 including a shelf at each side of said stand and located at right angles to the operator stations, the shelf at one side supporting large pans of multiple trayed products to be wrapped, and at the opposite side, for receiving completely weighed, wrapped and labeled products.

9. The method of alternately weighing, wrapping and labeling packages by a pair of operators facing each other in a combined package weighing, handwrapping and label printing system, which system includes a roll stand for supporting a pair of rolls of stretch film and further including a pair of means for locating the lead edge at least one roll of film, each locating means bring within easy grasp of respective operators for pulling film therefrom, a single computing weighing scale for both operators having a platter at approximately waist height within easy reach of both operators, a pair of heat sealing pads and a pair of film cutting means, each pad and each cutting means being between respective operators and the scale platter, means signaling the completion of each weighing by said scale, and means for inhibiting completion of weighing of a second package until the label for the next previous package has been removed from the printer, said method including the steps of:

a first operator loading trayed produce on the platter, weighing it and grasping film in preparation for wrapping a first package, providing a signal in response to completion of weighing said first tray, hand wrapping and sealing the package by said first operator, and removing the label from the printer and applying the label to the package by said first operator, the improvement comprising:

loading a second package on the platter by a second operator upon removal of the first weighed package by said first operator from the scale platter, the second operator commencing operation while the first operator is wrapping and labeling the first package, and again providing a signal when the first operator has removed his label, the first operator loading a third package and continuing with the alternating weighing, wrapping and labeling sequence.

10. The method of claim 9 wherein completion of weighing is indicated by transmission of the weight signal from the scale to the printer for commencement of printing.

11. The method of claim 9 wherein the signal is audible.

* * * * *